US009295368B2

(12) United States Patent
Feddema

(10) Patent No.: US 9,295,368 B2
(45) Date of Patent: Mar. 29, 2016

(54) DISHWASHER WITH HYDRAULICALLY DRIVEN SPRAYER

(71) Applicant: Whirlpool Corporation, Benton Harbor, MI (US)

(72) Inventor: Mark S. Feddema, Kalamazoo, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 389 days.

(21) Appl. No.: 13/782,086

(22) Filed: Mar. 1, 2013

(65) Prior Publication Data

US 2014/0246059 A1 Sep. 4, 2014

(51) Int. Cl.
*A47L 15/42* (2006.01)
*A47L 15/23* (2006.01)

(52) U.S. Cl.
CPC ..... *A47L 15/428* (2013.01); *A47L 15/23* (2013.01); *A47L 15/4289* (2013.01)

(58) Field of Classification Search
None
See application file for complete search history.

(56) References Cited

U.S. PATENT DOCUMENTS

| | | | | |
|---|---|---|---|---|
| 3,064,664 | A | 11/1962 | Warhus | |
| 3,146,953 | A | 9/1964 | Komanns | |
| 3,253,784 | A | 5/1966 | Long et al. | |
| 3,709,236 | A | 1/1973 | Field et al. | |
| 3,771,725 | A | 11/1973 | Jenkins et al. | |
| 3,797,509 | A * | 3/1974 | Fukuzawa | A47L 15/4282 134/178 |
| 4,266,565 | A | 5/1981 | Gurubatham | |
| 4,509,687 | A | 4/1985 | Cushing | |
| 4,993,444 | A | 2/1991 | Toriyama et al. | |
| 5,331,986 | A | 7/1994 | Lim et al. | |
| 5,415,350 | A | 5/1995 | Yoon et al. | |
| 5,427,129 | A | 6/1995 | Young, Jr. et al. | |
| 2,726,666 | A | 12/1995 | Oxford | |
| 5,546,968 | A | 8/1996 | Jeon et al. | |
| 5,577,665 | A | 11/1996 | Chang | |
| 5,601,100 | A | 2/1997 | Kawakami et al. | |
| 5,609,174 | A | 3/1997 | Ferguson | |
| 5,655,556 | A * | 8/1997 | Guerrera | A47L 15/23 134/176 |
| 5,673,714 | A | 10/1997 | Campagnolo et al. | |
| 5,697,392 | A | 12/1997 | Johnson et al. | |
| 5,944,037 | A | 8/1999 | Sinyong et al. | |
| 5,964,232 | A | 10/1999 | Chung | |
| 6,053,185 | A | 4/2000 | Beevers | |
| 6,325,083 | B1 | 12/2001 | Worter | |
| 7,314,188 | B2 | 1/2008 | Watson et al. | |

(Continued)

FOREIGN PATENT DOCUMENTS

| | | |
|---|---|---|
| DE | 7024995 U | 6/1970 |
| DE | 4036930 A1 | 5/1992 |

(Continued)

OTHER PUBLICATIONS

European Search Report for Corresponding EP 12185510.0, Dec. 19, 2012.

(Continued)

*Primary Examiner* — Michael Barr
*Assistant Examiner* — Cristi Tate-Sims

(57) ABSTRACT

A dishwasher includes a tub at least partially defining a treating chamber and a spraying system having a sprayer supplying liquid to the treating chamber. The sprayer may include a liquid passage and at least one spray outlet to emit a spray to wash the dishes and at least one drive outlet to emit a spray to rotate the sprayer. A valve body may adjust the amount of liquid emitted from the at least one drive outlet.

17 Claims, 7 Drawing Sheets

(56) References Cited

U.S. PATENT DOCUMENTS

| | | | | |
|---|---|---|---|---|
| 7,331,356 | B2 | 2/2008 | VanderRoest et al. | |
| 7,445,013 | B2 | 11/2008 | VanderRoest et al. | |
| 7,475,696 | B2 | 1/2009 | Vanderroest et al. | |
| 7,493,907 | B2 | 2/2009 | Roh | |
| 7,523,758 | B2 | 4/2009 | Vanderroest et al. | |
| 7,594,513 | B2 | 9/2009 | VanderRoest et al. | |
| 7,673,639 | B2 | 3/2010 | Shin | |
| 7,810,512 | B2 | 10/2010 | Pyo et al. | |
| 7,896,977 | B2 | 3/2011 | Gillum et al. | |
| 7,935,194 | B2 | 5/2011 | Rolek | |
| 7,959,744 | B2 | 6/2011 | Sundaram et al. | |
| 7,980,260 | B2 | 7/2011 | Bertsch et al. | |
| 8,113,222 | B2 | 2/2012 | Bertsch et al. | |
| 8,137,479 | B2 | 3/2012 | Vanderroest et al. | |
| 8,187,390 | B2 | 5/2012 | Vanderroest et al. | |
| 8,210,191 | B2 | 7/2012 | Gnadinger et al. | |
| 8,282,741 | B2 | 10/2012 | Bertsch et al. | |
| 2006/0278258 | A1 | 12/2006 | Kara et al. | |
| 2007/0056613 | A1 | 3/2007 | Haas et al. | |
| 2007/0289615 | A1 | 12/2007 | Shin | |
| 2009/0101182 | A1 | 4/2009 | Buesing et al. | |
| 2009/0101185 | A1 | 4/2009 | Pardini | |
| 2009/0159103 | A1 | 6/2009 | Gillum et al. | |
| 2010/0139719 | A1* | 6/2010 | Gnadinger et al. | 134/56 D |
| 2011/0030742 | A1 | 2/2011 | Dalsing et al. | |
| 2011/0203619 | A1 | 8/2011 | Kara et al. | |
| 2011/0303250 | A1 | 12/2011 | Delgado et al. | |
| 2012/0279530 | A1 | 11/2012 | Thiyagarajan | |
| 2012/0279536 | A1 | 11/2012 | Adams et al. | |
| 2013/0074886 | A1 | 3/2013 | Feddema et al. | |
| 2013/0074888 | A1 | 3/2013 | Feddema | |
| 2013/0074890 | A1 | 3/2013 | Feddema et al. | |
| 2014/0054395 | A1 | 2/2014 | Heisele et al. | |

FOREIGN PATENT DOCUMENTS

| | | | |
|---|---|---|---|
| DE | 102010043019 | A1 | 5/2012 |
| DE | 102011053666 | A1 | 5/2012 |
| EP | 0524102 | A1 | 1/1993 |
| EP | 0764421 | A1 | 3/1997 |
| EP | 0795292 | A2 | 9/1997 |
| EP | 0943281 | A2 | 9/1999 |
| EP | 0943282 | A2 | 9/1999 |
| EP | 1040786 | A1 | 10/2000 |
| EP | 1040787 | A1 | 10/2000 |
| EP | 1252856 | A2 | 10/2002 |
| EP | 1277430 | A1 | 1/2003 |
| EP | 1334687 | A1 | 8/2003 |
| EP | 2292134 | A1 | 3/2011 |
| EP | 2572624 | A1 | 3/2013 |
| GB | 2019204 | A | 10/1979 |
| GB | 2199734 | A | 7/1988 |
| GB | 2215990 | A | 10/1989 |
| JP | 60053120 | | 3/1985 |
| JP | 4033632 | A | 2/1992 |
| JP | 5184514 | A | 7/1993 |
| JP | 8089467 | A | 4/1996 |
| JP | 9164107 | A | 6/1997 |
| JP | 10243910 | A | 9/1998 |
| JP | 11019019 | A | 1/1999 |
| JP | 11076127 | A | 3/1999 |
| JP | 2004113683 | A | 4/2004 |
| KR | 200156558 | Y1 | 9/1999 |
| KR | 20060029567 | A | 4/2006 |
| KR | 20090037299 | A | 4/2009 |
| WO | 2010012703 | A2 | 2/2010 |
| WO | 2011144540 | A2 | 11/2011 |
| WO | 2011154471 | A1 | 12/2011 |
| WO | 2012065873 | A2 | 5/2012 |

OTHER PUBLICATIONS

European Search Report for Corresponding EP 12185514.2, Dec. 6, 2012.

European Search Report for Corresponding EP 12185512.6, Dec. 6, 2012.

European Search Report for Corresponding EP14155441.0, May 30, 2014.

German Search Report for Counterpart DE102013111241.2, May 23, 2014.

* cited by examiner

DISHWASHER WITH HYDRAULICALLY DRIVEN SPRAYER

BACKGROUND OF THE INVENTION

Contemporary automatic dishwashers for use in a typical household include a tub and at least one rack or basket for supporting soiled dishes within the tub. A spraying system may be provided for recirculating liquid throughout the tub to remove soils from the dishes. The spraying system may include various sprayers including a hydraulically driven sprayer.

SUMMARY

An embodiment of the invention relates to a dishwasher having a tub at least partially defining a treating chamber, a spraying system supplying liquid to the treating chamber and having a sprayer with a body mounted within the tub for movement about a rotatable axis and having an interior, a liquid passage provided in the interior, at least one spray outlet configured to emit a spray of liquid into the treating chamber to wash the dishes, at least one drive outlet configured to emit a spray of liquid to rotate the body about the rotational axis, and a valve body moveable relative to the body to adjust a speed of rotation of the body.

DESCRIPTION OF EMBODIMENTS OF THE INVENTION

Figure 1:
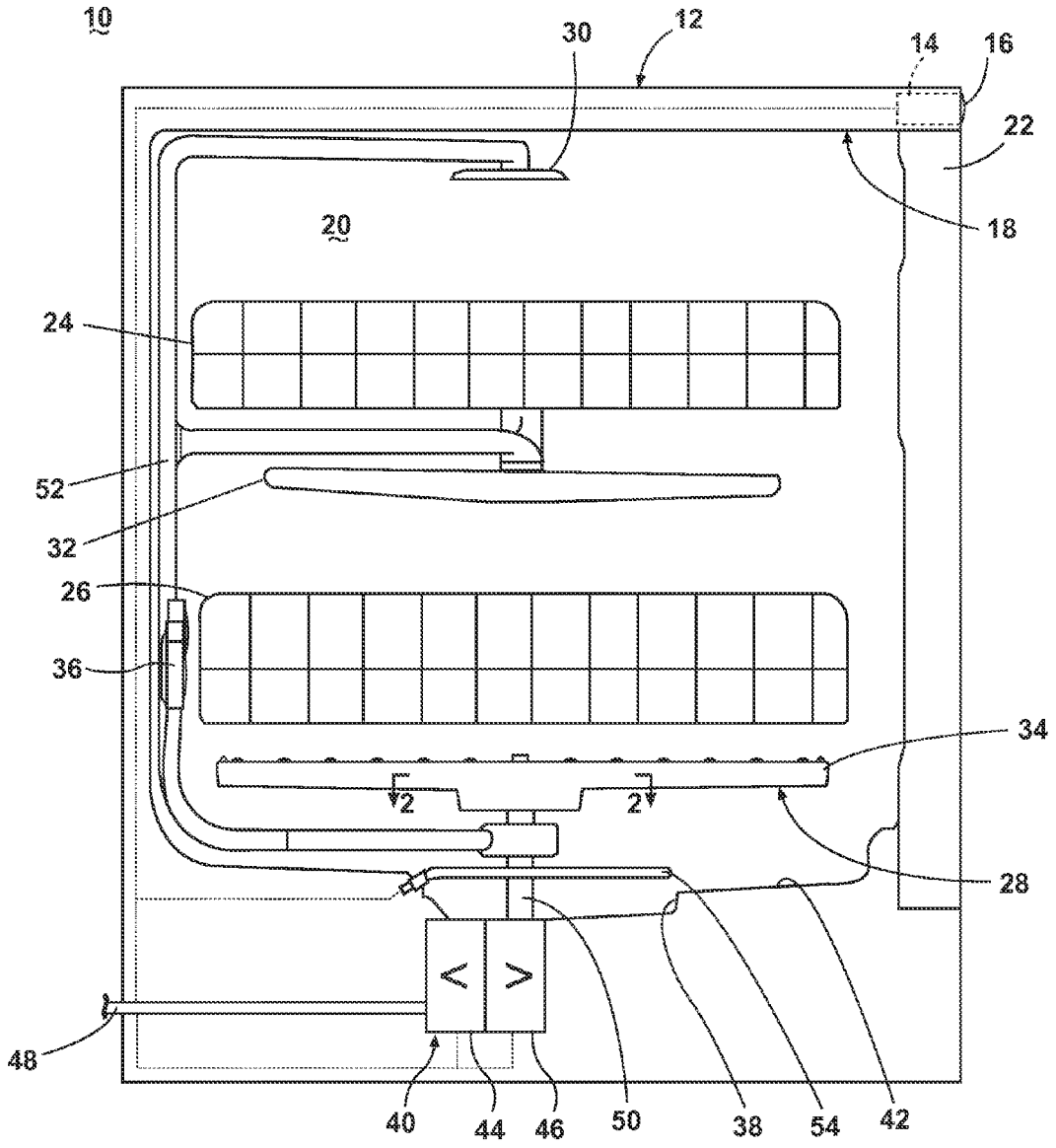
FIG. 1 is a schematic view of a dishwasher with a spray system according an embodiment of the invention.

Referring to FIG. 1, an automatic dishwasher 10 having a cabinet 12 defining an interior is illustrated. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers, multi-tub dishwashers, or drawer-type dishwashers.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the cabinet 12 and at least partially defines a treating chamber 20 with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Dish holders in the form of upper and lower racks 24, 26 are located within the treating chamber 20 and receive dishes for being treated. The racks 24, 26 are mounted for slidable movement in and out of the treating chamber 20 for ease of loading and unloading. As used in this description, the term "dish(es)" is intended to be generic to any item, single or plural, that may be treated in the dishwasher 10, including, without limitation; utensils, plates, pots, bowls, pans, glassware, and silverware. While not shown, additional dish holders, such as a silverware basket on the interior of the door 22, may also be provided.

A spraying system 28 may be provided for spraying liquid into the treating chamber 20 and is illustrated in the form of an upper sprayer 30, a mid-level rotatable sprayer 32, a lower rotatable spray arm 34, and a spray manifold 36. The upper sprayer 30 may be located above the upper rack 24 and is illustrated as a fixed spray nozzle that sprays liquid downwardly within the treating chamber 20. Mid-level rotatable sprayer 32 and lower rotatable spray arm 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system 28 to supply liquid into the treating chamber 20. While the pump assembly 40 is illustrated as having separate drain and recirculation pumps 44 and 46 in an alternative embodiment, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

As shown herein, the recirculation pump 46 has an outlet conduit 50 in fluid communication with the spraying system 28 for discharging wash liquid from the recirculation pump 46 to the sprayers 30-36. As illustrated, liquid may be supplied to the spray manifold 36, mid-level rotatable sprayer 32, and upper sprayer 30 through a supply tube 52 that extends generally rearward from the recirculation pump 46 and upwardly along a rear wall of the tub 18. While the supply tube 52 ultimately supplies liquid to the spray manifold 36, mid-level rotatable sprayer 32, and upper sprayer 30, it may fluidly communicate with one or more manifold tubes that directly transport liquid to the spray manifold 36, mid-level rotatable sprayer 32, and upper sprayer 30. Further, diverters (not shown) may be provided within the spraying system 28 such that liquid may be selectively supplied to each of the sprayers 30-36. The sprayers 30-36 spray water and/or treating chemistry onto the dish racks 24, 26 (and hence any dishes positioned thereon) to effect a recirculation of the liquid from the treating chamber 20 to the liquid spraying system 28 to define a recirculation flow path.

A heating system having a heater 54 may be located within or near the sump 38 for heating liquid contained in the sump 38. A filtering system (not shown) may be fluidly coupled with the recirculation flow path for filtering the recirculated liquid.

Figure 2:
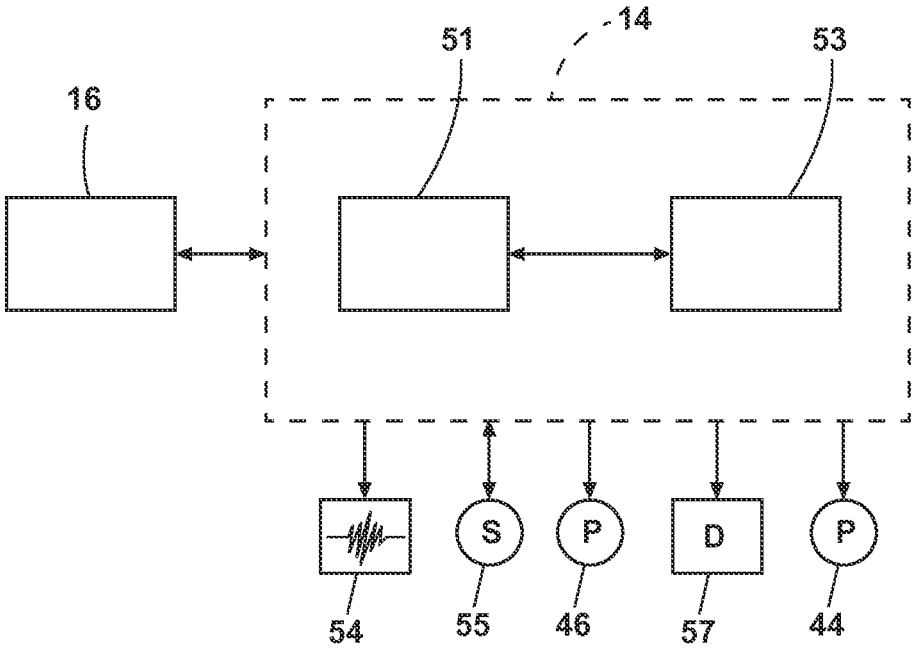
FIG. 2 is a schematic view of a control system of the dishwasher of FIG. 1.

As illustrated in FIG. 2, the controller 14 may be provided with a memory 51 and a central processing unit (CPU) 53. The memory 51 may be used for storing control software that may be executed by the CPU 53 in completing a cycle of operation using the dishwasher 10 and any additional software. For example, the memory 51 may store one or more pre-programmed cycles of operation that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

The controller 14 may be operably coupled with one or more components of the dishwasher 10 for communicating with and controlling the operation of the components to complete a cycle of operation. For example, the controller 14 may be coupled with the recirculation pump 46 for circulation of liquid in the tub 18 and the drain pump 44 for drainage of liquid in the tub 18. The controller 14 may also be operably coupled to the heater 54. Further, the controller 14 may also be coupled with one or more optional sensors 55. Non-limiting examples of optional sensors 55 that may be communicably coupled with the controller 14 include a moisture sensor, a door sensor, a temperature sensor, a detergent and rinse aid presence/type sensor(s). The controller 14 may also be coupled to a dispenser 57, which may dispense a detergent during the wash step of the cycle of operation or a rinse aid during the rinse step of the cycle of operation.

Figure 3A:
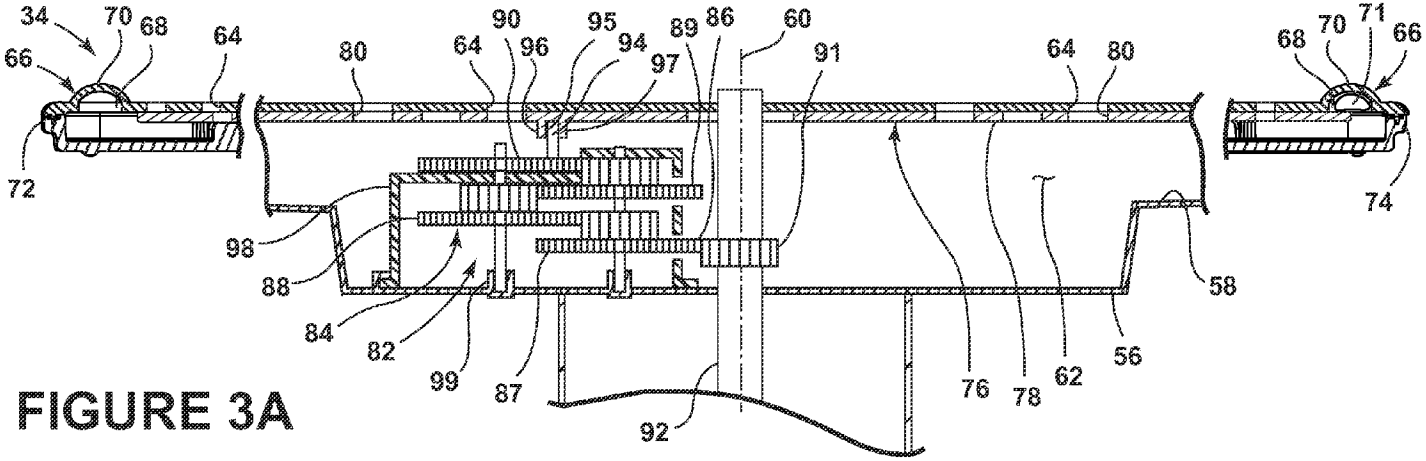
FIGS. 3A-3B are cross-sectional views of a rotatable spray arm according to an embodiment of the invention that may be used in the spray system of the dishwasher of FIG. 1 and illustrating a valve body for the rotatable spray arm in various positions.

FIG. 3A illustrates a cross-sectional view of the lower rotatable spray arm 34 comprising a body 56 having an interior 58 and mounted within the tub 18 for movement about a rotatable axis 60. A liquid passage 62 may be provided in the interior 58 and fluidly couples with the outlet conduit 50 and recirculation pump 46. A plurality of spray outlets 64 extend through the body 56 and may be in fluid communication with the liquid passage 62. As illustrated, the interior 58 defines the liquid passage 62. However, a separate liquid passage 62 may be located within the interior 58.

The lower rotatable spray arm 34 may rely on liquid pumped from the recirculation pump 46 to provide hydraulic drive to rotate the body 56 about the rotatable axis 60. More specifically, a hydraulic drive 66 may be formed by at least one drive outlet 68 extending through the body 56 such that it may be fluidly coupled with the liquid passage 62. The at least one drive outlet 68 may be oriented such that liquid emitted from the hydraulic drive outlet 68 effects the rotation of the lower rotatable spray arm 34. Any number of drive outlets 68 may be used including a single drive outlet 68. In the illustrated example, two drive outlets 68 have been included on the body 56. It is contemplated that the drive outlets 68 may be located on various portions of the body 56 including a side or bottom surface of the body 56 so long as the drive outlets 68 are configured to emit a spray of liquid to rotate the body 56 about the rotational axis 60. To generate the greatest torque, the drive outlets may be located near the tip of the body 56, which is the greatest distance from the axis of rotation.

A nozzle 70 may be provided on the body 56 and may be fluidly coupled with the drive outlet 68. The nozzle 70 may be oriented such that liquid emitted from the nozzle 70, such as through the opening 71, effects the rotation of the lower rotatable spray arm 34. A first drive outlet 68 and corresponding nozzle 70 are located on a first end 72 of the lower rotatable spray arm 34 and a second drive outlet 68 and nozzle 70 are located on a second end 74 of the lower rotatable spray arm 34. The drive outlets 68 and the nozzles 70 do not need to be symmetrical and may allow different volumetric flow rates of liquid to be emitted. The drive outlets 68 and the corresponding nozzles 70 are located such that when the recirculation pump 46 is activated, the lower rotatable spray arm 34 rotates. It will be understood that the lower rotatable spray arm 34 may include the drive outlet 68 and nozzle 70 combination or that the drive outlet 68 alone may be used to effect the rotation of the lower rotatable spray arm 34.

A valve body 76 is illustrated as being located within the interior 58 and may be selectively moveable relative to the body 56 to fluidly couple different portions of the drive outlets 68 to the liquid passage 62 to alter an amount of liquid emitted from the drive outlets 68. Altering the amount of liquid may include altering a volumetric flow rate emitted from at least one of the drive outlets 68. Altering the amount of liquid emitted from at least one of the drive outlets 68 adjusts the speed of rotation of the body 56. For example, if the valve body 76 is moved such that a greater amount of liquid is emitted from the drive outlet 68, then the body 56 will be rotated faster because the hydraulic drive provided by the liquid being emitted from the drive outlet 68 is greater. Conversely, if the valve body 76 is moved such that a lesser amount of liquid is emitted from the drive outlet 68, then the body 56 will be rotated slower because the hydraulic drive provided by the liquid being emitted from the drive outlet 68 is less. It will be understood that if there is more than one drive outlet 68, then the liquid emitted from the multiple drive outlets 68 may be altered by the valve body 76 to adjust a speed of rotation of the body 56.

The valve body 76 may be reciprocally moveable within the body 56. The valve body 76 has been illustrated as including a slidable plate 78. The slidable plate 78 may be slidably mounted within the interior 58 of the body 56 to fluidly couple different portions of the drive outlets 68 to the liquid passage 62 to alter an amount of liquid emitted from the drive outlets 68 to adjust a speed of rotation of the body 56. The valve body 76 may alter the amount of liquid emitted from the drive outlets 68 in any suitable manner including that a fluid passage in the slidable plate 78 may be used to fluidly coupled the drive outlets 68 to the liquid passage 62 and movement of such a liquid passage and the slidable plate 78 may alter the amount of liquid emitted.

It is also contemplated that the valve body 76 may be operable to selectively fluidly couple at least some of the spray outlets 64 to the liquid passage 62. More specifically, the slidable plate 78 has been illustrated as including multiple openings 80. When the slidable plate 78 moves within the body 56 of the lower rotatable spray arm 34, the multiple openings 80 may fluidly couple and uncouple various spray outlets 64 to the liquid passage 62. In this way, different spray outlets 64 may be selected with the sliding of the slidable plate 78. For example, different subsets of spray outlets 64 may be located on different portions of the arms such that the selection of a particular subset of spray outlets 64 controls the location of the spray. For example, one subset of spray outlets 64 may be located at the ends of the lower rotatable spray arm 34 to direct liquid solely into the hard to reach areas of the treating chamber 20. The valve body 76 may be configured in any manner of ways including that the valve body 76 may be configured to reduce the speed of rotation of the lower rotatable spray arm 34 when the spray outlet 64 emits a spray of liquid in a corner of the treating chamber 20.

An actuator 82 may be operably coupled with the valve body 76 and may move the valve body 76 based on the rotation of the lower rotatable spray arm 34. The actuator 82 may be any suitable mechanism capable of moving the valve body 76 between various positions based on the rotation of the lower rotatable spray arm 34. By way of a non-limiting example, the actuator 82 may include a drive system 84 operably coupled with the lower rotatable spray arm 34 and the valve body 76 such that rotation of the lower rotatable spray arm 34 moves the valve body 76 between the various positions. The drive system 84 has been illustrated as including a gear assembly 86 operably coupling the lower rotatable spray arm 34 and the valve body 76 such that rotation of the lower rotatable spray arm 34 moves the gear assembly 86, which, in turn, moves the slidable plate 78. Thus, the gear assembly 86 helps convert the rotational motion of the lower rotatable spray arm 34 into sliding motion for the slidable plate 78. The gear assembly 86 has been illustrated as including a gear chain having a first gear 87, second gear 88, third gear 89, fourth gear 90, and a fixed gear 91. A fixed shaft 92 may extend through a portion of the body 56 such that the lower rotatable spray arm 34 is rotationally mounted on the fixed shaft 92. Further, the fixed gear 91 may be fixedly mounted on the fixed shaft 92.

A pin 94 may be included in the drive system 84 and may be operably coupled with and extending from an upper portion of the fourth gear 90 and received within a channel 95 located in the valve body 76 to operably couple the gear assembly 86 with the slidable plate 78. The channel 95 may be a depression in a bottom portion of the slidable plate 78 or as illustrated may be formed between two opposing walls 96, 97 extending downwardly from the bottom of the slidable plate 78. A bracket 98 may be located within the interior 58 and houses at least a portion of the gear assembly 86 to provide support for the gear assembly 86. Portions of the gear assembly 86 may also be held within supports 99 formed by the body 56 of the lower rotatable spray arm assembly 34.

The operation of the dishwasher 10 with the described lower rotatable spray arm structure will now be described. The user will initially select a cycle of operation via the user interface 16, with the cycle of operation being implemented by the controller 14 controlling various components of the dishwasher 10 to implement the selected cycle of operation in the treating chamber 20. Examples of cycles of operation include normal, light/china, heavy/pots and pans, and rinse only. The cycles of operation may include one or more of the following steps: a wash step, a rinse step, and a drying step. The wash step may further include a pre-wash step and a main wash step. The rinse step may also include multiple steps such as one or more additional rinsing steps performed in addition to a first rinsing. During such cycles, wash fluid, such as water and/or treating chemistry (i.e., water and/or detergents, enzymes, surfactants, and other cleaning or conditioning chemistry) passes from the recirculation pump 46 into the spraying system 28 and then exits the spraying system through the sprayers 30-36.

As liquid is supplied to the lower rotatable spray arm 34, liquid is emitted from the drive outlets 68 and the lower rotatable spray arm 34 is hydraulically driven. As the lower rotatable spray arm 34 is hydraulically rotated about the fixed shaft 92, the first gear 87, which is mounted between the fixed gear 91 and the second gear 88, is rotatably mounted within the support 99, and moves with the rotation of the lower rotatable spray arm 34, may be driven around the fixed gear 91. Thus, the first gear 87 is also hydraulically driven and may be caused to circle about the fixed gear 91 as the lower rotatable spray arm 34 rotates about the fixed shaft 92. As the first gear 87 is driven about the fixed gear 91, it in turn causes the rotation of the second gear 88, the third gear 89, and the fourth gear 90.

As the fourth gear 90 rotates, the pin 94 rotates within the interior 58 of the lower rotatable spray arm 34. As the pin 94 rotates, it moves within the boundaries of the channel 95 and causes the slidable plate 78 to be moved back and forth within the interior 58 of the lower rotatable spray arm 34. More specifically, as the pin 94 rotates with the fourth gear 90, the pin 94 pushes on the wall 96 for a first portion of a full rotation of the fourth gear 90 and pushes on the wall 97 for a second portion of the full rotation of the fourth gear 90. When the pin 94 pushes on the wall 97 it moves the slidable plate 78 to a first position illustrated in FIG. 3A. The first position may allow the slidable plate 78 to alter an amount of liquid emitted from one drive outlet 68 while leaving the amount of liquid emitted from the other drive outlet 68 unaltered. In the first position the slidable plate 78 is altering the amount of liquid emitted from the drive outlet 68 on the second end 74 and is not altering the amount of liquid emitted from the drive outlet 68 on the first end 72. More specifically, in the first position the slidable plate 78 covers a portion of the drive outlet 68 on the second end 74, which reduces the amount of liquid that may be emitted from the drive outlet 68. This reduces the amount of liquid that may be emitted from the drive outlet 68 and slows the rotational speed of the lower rotatable spray arm 34 as well as the rotational speed of the gear assembly 86. The slidable plate 78 may stay in the first position until the pin 94 is rotationally advanced to a point where it begins to push on the wall 96.

Figure 3B:
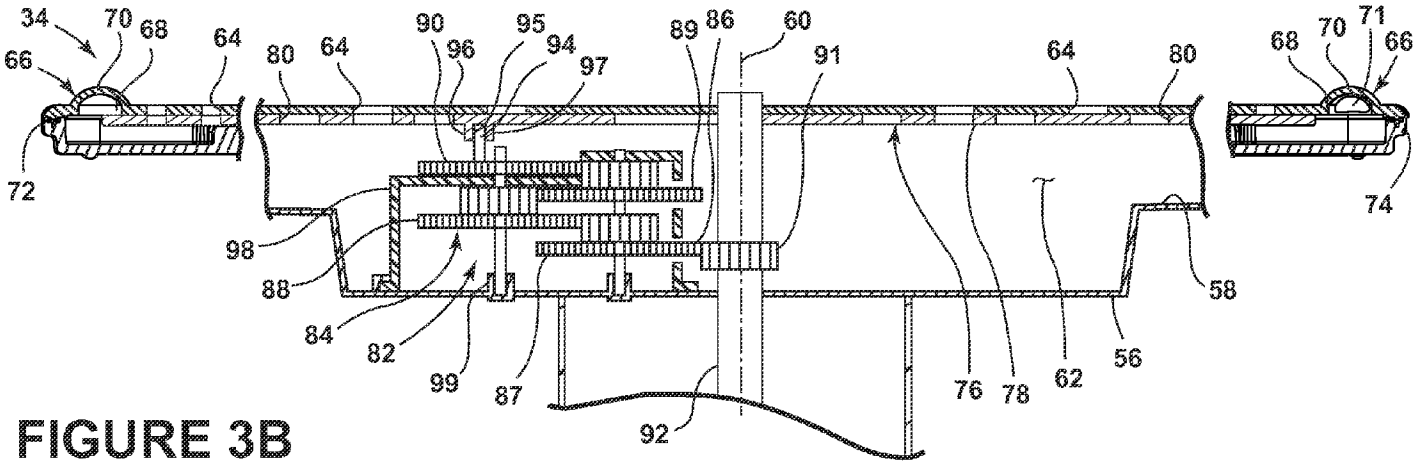

When the pin 94 pushes on the wall 96 it moves the slidable plate 78 in the opposite direction until it reaches the second position illustrated in FIG. 3B. In the second position, the slidable plate 78 is altering the amount of liquid emitted from the drive outlet 68 on the first end 72 and is not altering the amount of liquid emitted from the drive outlet 68 on the second end 74. In the second position, the slidable plate 78 covers a portion of the drive outlet 68 on the first end 72, which reduces the amount of liquid that may be emitted from the drive outlet 68. This causes the lower rotatable spray arm 34 to rotate at a reduced rotational speed and changes the rotational speed of the gear assembly 86 accordingly. It will be understood that the amount of liquid emitted by the drive outlets 68 in the first and second positions may be different such that the body 56 rotates at a first speed of rotation when the valve body 76 is in the first position and the body 56 rotates at a second speed of rotation when the valve body 76 is in the second position.

The slidable plate 78 may stay in the second position until the pin 94 is rotationally advanced to a point where it begins to again push on the wall 97. As the fourth gear 90 continues to rotate, the pin 94 continues to alternatively push against one of the walls 96 and 97 and continues to move the slidable plate 78 into the first and second positions. In this manner, the movement of the pin 94 within the channel 95 operably couples the gear assembly 86 to the slidable plate 78 such that the rotation of the gear assembly 86 may be converted into translational movement of the slidable plate 78. Essentially, the actuator 82 allows the valve body 76 to move between the at least two positions based on a rotational orientation of the lower rotatable spray arm 34 and moves the valve body 76 to control the amount of liquid emitted from the drive outlets 68.

The slidable plate 78 may be moved into any number of positions including a variety of positions between the illustrated first position and the second position. The valve body 76 may allow at least portions of the drive outlets 68 to be fluidly coupled to the liquid passage 62 regardless of the position of the valve body 76. The body 56 may rotate at a third speed of rotation if the valve body 76 is configured to be capable of a third position that alters an amount of liquid emitted from both drive outlets 68. Alternatively, the body 56 may rotate at yet another speed of rotation if the valve body 76 is configured to be capable of a position that does not alter an amount of liquid emitted from either of the drive outlets 68.

Rotation of the body 56 moves the valve body 76 to change the speed of rotation of the body 56. As the slidable plate 78 moves side to side inside the lower rotatable spray arm 34, the valve body 76 alters the speed of rotation of the lower rotatable spray arm 34. Further, the valve body 76 may be used to fluidly couple and uncouple the spray outlets 64 to the liquid passage 62. It will be understood that liquid may be still be sprayed from the plurality of spray outlets 64 if at least a portion of the multiple openings 80 fluidly couples a portion of the plurality of spray outlets 64. It has also been contemplated that the valve body 76 may be shaped such that there may be a point where the multiple openings 80 in the valve body 76 do not allow for the fluid to enter any of the plurality of spray outlets 64 except for the hydraulic drive outlets 68.

The gear chain of the gear assembly 84 is illustrated as forming a reduction gear assembly. That is the valve body 76 is moved between the at least two positions by the actuator 82 over multiple rotations of the lower rotatable spray arm 34. As illustrated, the reduction gear assembly may provide a 40:1 gear reduction such that the valve body 76 will slide to the first and second positions over forty revolutions of the lower rotatable spray arm 34. The gear ratios of the gear assembly 84 may be selected to control the relative movement of the valve body 76 to the lower rotatable spray arm 34. The gear ratio of the gear assembly 84 is a function of the ratios of gears forming the gear assembly 84. Thus, the gears may be selected to provide a desired ratio to provide a desired fluid coupling time between the liquid passage 62 and the first and second subsets of spray outlets 64. The gear reduction ratio may also be selected to aid in allowing the hydraulic drive outlets 68 to overcome the friction created by the valve body 76.

As the lower rotatable spray arm 34 turns, the valve body 76 continues to move between the first and second positions and continues to selectively adjust the speed of rotation of the body 56. With the above described valve body 76 and actuator 82, the time that the body 56 rotates at any particular speed of rotation may be controlled by the gear ratio, the spacing between the two opposing walls 96, 97 extending around the pin 94, and the flow rate of liquid. The movement of the lower rotatable spray arm 34 and the valve body 76 ends when fluid is no longer pumped by the recirculation pump 46 to the lower rotatable spray arm 34 such that the lower rotatable spray arm 34 is no longer hydraulically driven.

Further, it is contemplated that the valve body may be moveable relative to the body to fluidly couple different portions of the at least one drive outlet to the liquid passage to alter a trajectory of liquid emitted from the at least one drive outlet to adjust a speed of rotation of the body. Thus, instead of altering an amount of liquid emitted, the valve body may alter a trajectory of the liquid emitted to adjust a speed of rotation of the body. More specifically, if the valve body is moved such that the angle of spray from the drive outlet is, for example, 45 degrees, then a certain amount of that spray would be dedicated to driving the rotation of the body and the body would be rotated a first speed. If the valve body is moved such that the angle of spray from the drive outlet is, for example, 60 degrees, then a lesser amount of that spray would be dedicated to driving the rotation of the body and the body would rotate at a second slower speed.

Figure 4:
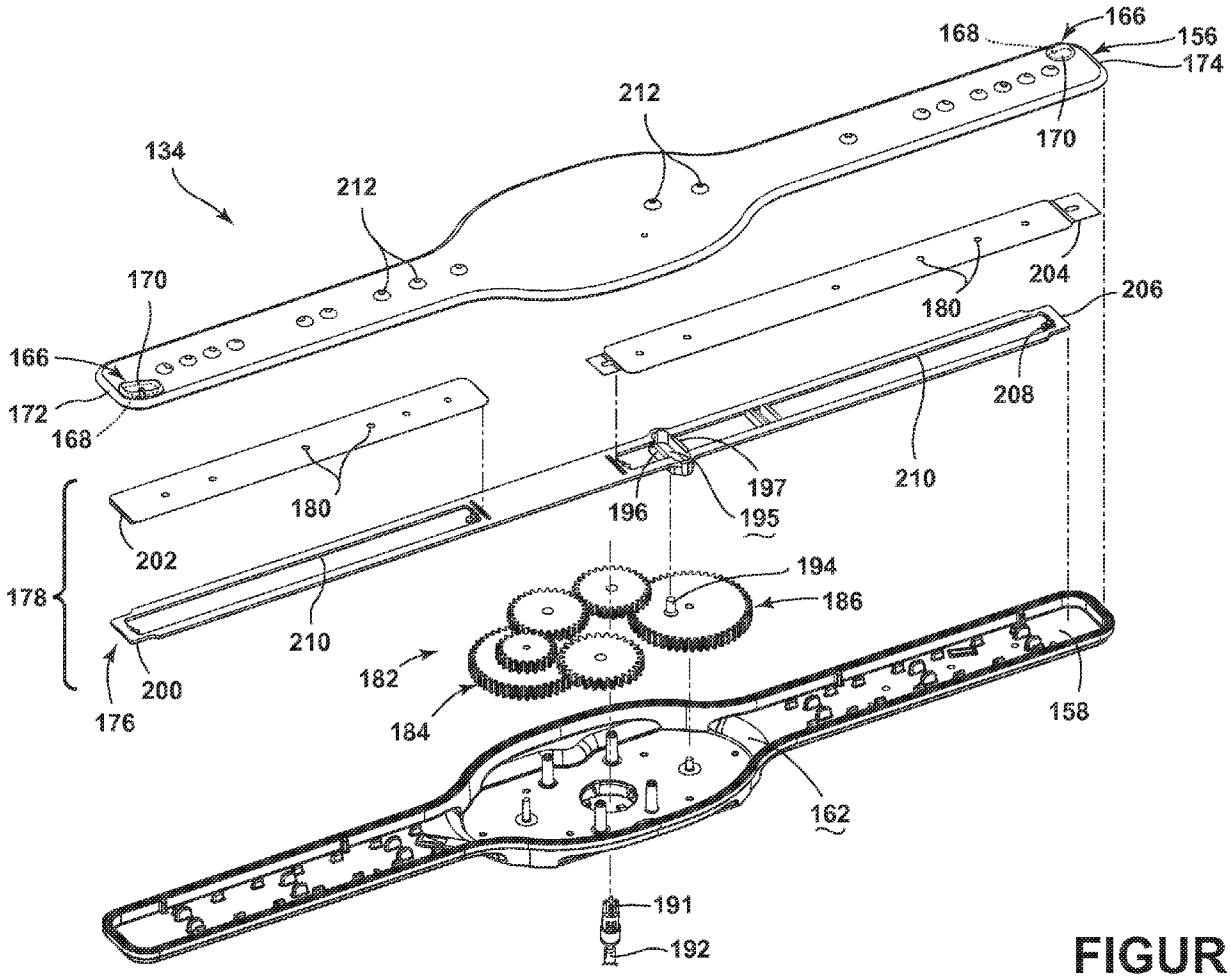
FIG. 4 is an exploded view of a rotatable spray arm according to an embodiment of the invention that may be used in the spray system of the dishwasher of FIG. 1.

While the valve body has been described and illustrated as a slidable plate in the above embodiment it is contemplated that the valve body may take any suitable form including that the slidable plate may take any suitable form. For example, the slidable plate may include a rigid plate, a flexible plate, or a thin film plate, which may be either flexible or rigid. Further, the valve body may include a moveable element and at least a portion may conform to the shape of the sprayer. FIG. 4 illustrates an alternative lower rotatable spray arm 134 and a valve body 176 according to a second embodiment of the invention. The lower rotatable spray arm 134 and valve body 176 are similar to the lower rotatable spray arm 34 and valve body 76 previously described and, therefore, like parts will be identified with like numerals increased by 100, with it being understood that the description of the like parts applies to the second embodiment, unless otherwise noted.

One difference between the lower rotatable spray arm 34 and the lower rotatable spray arm 134 is that the drive outlet 168 and nozzle 170 on the first end 172 of the lower rotatable spray arm 134 is different than the drive outlet 168 and nozzle 170 on the second end 174 of the lower rotatable spray arm 134. This may further allow for the rotational speed of the lower rotatable spray arm 134 to be varied depending on how the valve body 176 fluidly couples different portions of the drive outlets 168 to the liquid passage 162 to alter an amount of liquid emitted from the drive outlets 168. While each nozzle 170 has been illustrated differently it is contemplated that any suitable nozzle 170 may be used including that the nozzles 170 may be the same. It will be understood that no nozzles need be included and that the drive outlets 168 themselves may be configured to cause rotation of the body 156.

Another difference is that the slidable plate 178 is illustrated as including a frame 200 supporting a membrane 202. The membrane 202 may be supported or operably coupled to the frame 200 in any suitable manner. For example, the membrane 202 may be attached to the frame 200 of the slidable plate 178 at the ends of the membrane 202 to allow the membrane 202 to move and conform to the body 156. In the illustrated example, end portions 204 of the membrane 202 may be wrapped around end portions 206 of the frame 200. Tabs 208 may be used to retain the membrane 202 on the frame 200.

The membrane 202 may include openings 180, which may be in fluid communication with the liquid passage 162. The frame 200 may include open portions 210 to allow liquid to reach the membrane 202 from the liquid passage 162. The membrane 202 may be formed from any suitable material. For example, the membrane 202 may be formed from a flexible material such that it may conform to a shape of at least a portion of the lower rotatable spray arm 134 during use. The material may be able to withstand the high temperatures of the dishwasher 10 and the treating chemistry that is used in dishwasher 10.

As with the earlier embodiment, the lower rotatable spray arm 134 includes an interior 158 forming a liquid passage 162. The membrane 202 may be located within the interior 158 and may abut portions of the lower rotatable spray arm 134. Alternatively, the membrane 202 may be located outside the interior 158 of the lower rotatable spray arm 134 but still may be configured to conform to a shape of at least a portion of the lower rotatable spray arm 134 and alter an amount of liquid emitted from the drive outlets 168. In the illustrated example, the membrane 202 may located between the liquid passage 162 and portions of the drive outlets 168. The membrane 202 abuts the lower rotatable spray arm 134 to form a liquid seal between the lower rotatable spray arm 134 and the remainder of the liquid passage 162. Sealing rings may be provided along the interior 158 of the body 156, with one of the sealing rings surrounding each of the spray outlets 164 and each of the drive outlets 168. The sealing ring may create a larger effective outlet and allows for a longer fluid communication between the spray outlets 164 or drive outlets 168 and the liquid passage 162. The sealing ring may be a raised ring surrounding each spray outlets 164 and drive outlet 168 and may take any suitable form including that of an O-ring or other seal. The membrane 202 may be capable of sealing against the body 156 and/or the sealing rings to better seal the drive outlets 168 and the spray outlets 164 against the unintended flow of liquid from the liquid passage 162.

The drive system 184 has been illustrated as including a gear assembly 186 operably coupling the lower rotatable spray arm 134 and the valve body 176 such that rotation of the lower rotatable spray arm 134 moves the gear assembly 186 which in turn moves the slidable plate 178. The gear assembly 186 has been illustrated as including an additional gear and having a more horizontal layout as compared to the earlier described embodiment. The gear assembly 186 helps convert the rotational motion of the lower rotatable spray arm 134 into sliding motion of a reciprocating driver that relatively reciprocates the membrane 202 and the lower rotatable spray arm 134. In the illustrated example, the reciprocating driver includes the frame 200. The drive system 184 may also include a pin 194 operably coupled with and extending from an upper portion of a gear of the gear assembly 186 and received within a channel 195 located in the frame 200 to operably couple the gear assembly 186 with the slidable plate 178. The channel 195 may be a depression in a bottom portion of the frame 200 or as illustrated may be formed between two opposing walls 196, 197 formed in the frame 200. The membrane 202 and the lower rotatable spray arm 134 may be coupled for relative movement and the drive system 184 may reciprocate the membrane 202 relative to the lower rotatable spray arm 134. Alternatively, the reciprocating driver may reciprocate the membrane 202 relative to the driver. For example, while the membrane 202 is illustrated as being used in conjunction with the frame 200, which supports the membrane 202, it is contemplated that the membrane 202 may be operably coupled to the drive system 184 without the use of the frame 200. It will be understood that any suitable drive assembly may be used to move the membrane 202. For example, a different gear assembly may be used to achieve a higher gear reduction and longer dwell time.

Yet another difference is that additional nozzle structures 212 are provided on the body 156 and may be fluidly coupled with the spray outlets 164, which lead to the liquid passage 162. It is contemplated that any suitable nozzles may be operably coupled to the body 156 and that the nozzles 212 may provide any number of different spray patterns, including that the nozzles 212 may provide different spray patterns, although this need not be the case. Providing different spray patterns may be advantageous so as to provide for different cleaning effects from a single spray arm. For example, a first spray pattern may be a discrete, focused, and concentrated spray, which may provide a higher pressure spray. While a second spray pattern may be a wide angle diffused spray pattern that produces more of a shower as compared to a more concentrated spray pattern. The shower spray may be more suitable for distributing treating chemistry whereas the higher pressure spray may be more suitable for dislodging soils.

During operation, the lower rotatable spray arm 134 and drive system 184 operate much the same as in the first embodiment wherein as the lower rotatable spray arm 134 is rotated, gears in the drive system 184 are driven and the frame 200, to which the membrane 202 is mounted, is moved between the first, intermediate, and second positions. More specifically, as the pin 194 rotates, it moves within the boundaries of the channel 195 and causes the slidable plate 178 to be moved back and forth within the interior 158 of the lower rotatable spray arm 134. This causes the membrane 202 to overlap different portions of the drive outlets 168 to limit the fluid emitted from the drive outlets 168. More specifically, the membrane 202 may cause different portions of the at least one drive outlet 168 to fluidly couple to the liquid passage 162 to alter an amount of liquid emitted from the at least one drive outlet 168 to adjust a speed of rotation of the lower rotatable spray arm 134. Further, relative movement of the membrane 202 and lower rotatable spray arm 134 may selectively align the openings 180 with a subset of the spray outlets 164.

Figure 5A:
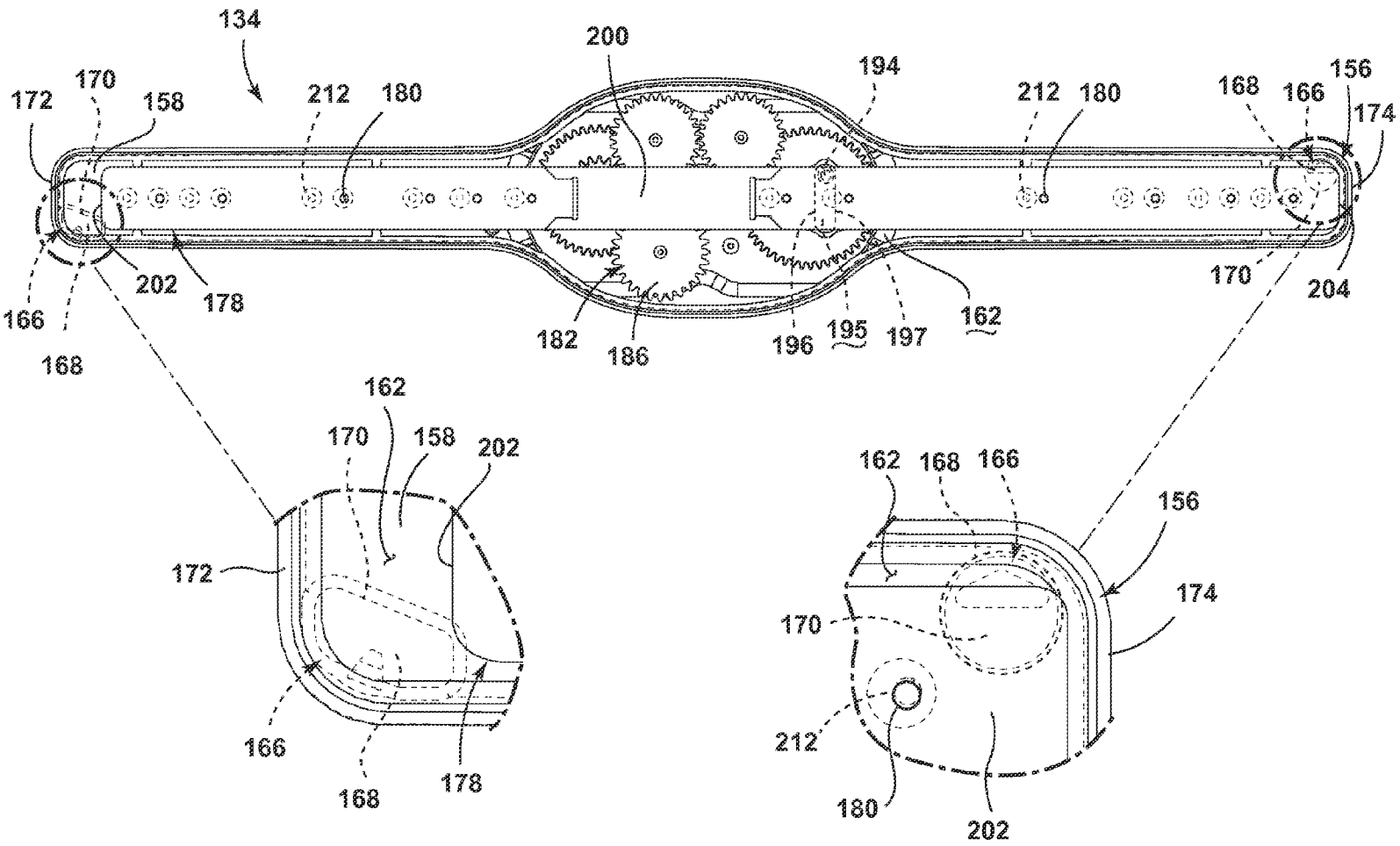
FIGS. 5A-5C are top views of the rotatable spray arm of FIG. 4 and illustrating a valve body for the rotatable spray arm in various positions.
Figure 5B:
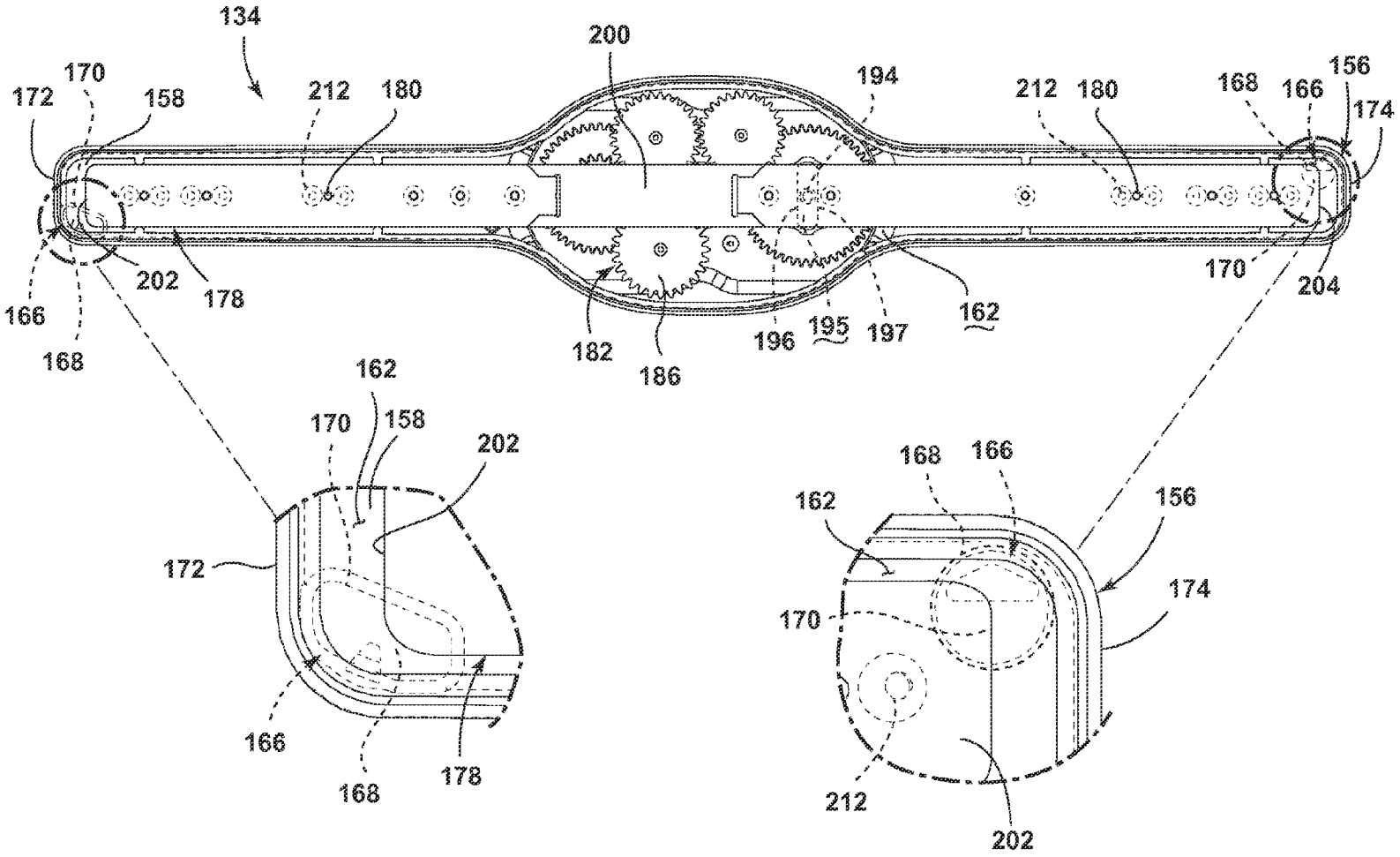
Figure 5C:
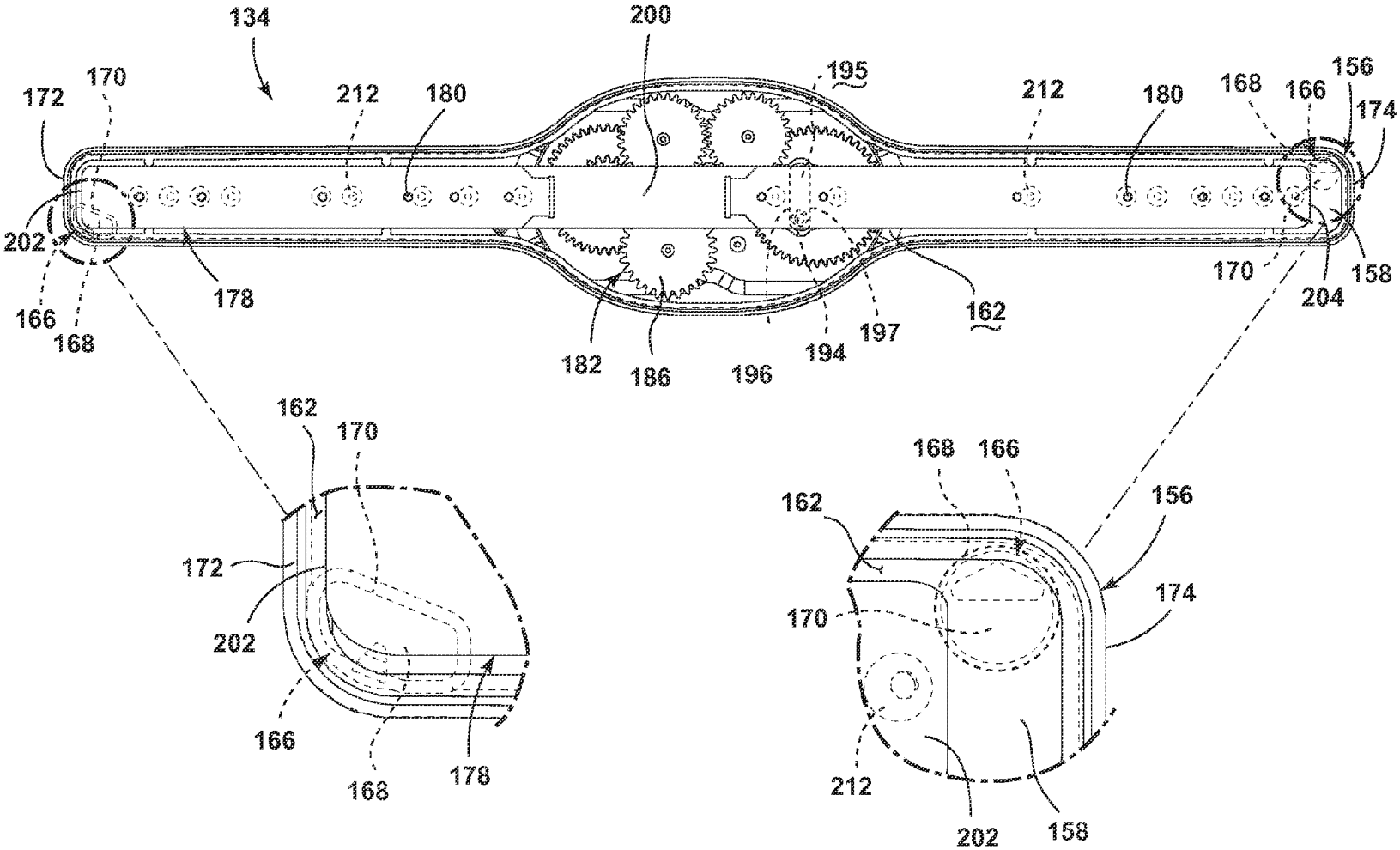

FIG. 5A illustrates the slidable plate 178 in a first position, FIG. 5B illustrates the slidable plate 178 in an intermediate position, and FIG. 5C illustrates the slidable plate 178 in a second position. In the first position, illustrated in FIG. 5A, the slidable plate 178 covers a portion of the drive outlet 168 on the second end 174, which reduces the amount of liquid that may be emitted from the drive outlet 168 on the second end 174 and results in a first rotational speed of the lower rotatable spray arm 134. In the intermediate position, illustrated in FIG. 5B, the slidable plate 178 covers a portion of the drive outlet 168 on the first side 172 and covers a portion of the drive outlet 168 on the second end 174. This reduces the amount of liquid that may be emitted from either of the drive outlets 168 and results in a second rotational speed of the lower rotatable spray arm 134. In the second position, illustrated in FIG. 5C the slidable plate 78 covers a portion of the drive outlet 168 on the first end 172, which reduces the amount of liquid that may be emitted from the drive outlet 168 on the first end and results in a third rotational speed of the lower rotatable spray arm 134.

The above described embodiments provide a variety of benefits including that they allow for the speed of rotation of the body to be adjusted. This may allow for better coverage of the treating chamber 20 as the rotation of the body may be reduced when liquid spray is being directed towards various parts of the treating chamber and increase the dwell time of the spray at these locations.

While the invention has been specifically described in connection with certain specific embodiments thereof, it is to be understood that this is by way of illustration and not of limitation. For example, it has been contemplated that the valve body and actuator may be located in other rotatable spray arms such as the mid-level rotatable spray arm. Further, other actuators may be used to control the movement of the valve body based on the rotation of the rotatable body and the illustrated actuators including gear assemblies are merely exemplary. Further, while the valve body has been illustrated and described as moving in a linear motion, it is contemplated that the valve body may alternatively be moved in any suitable manner including rotational motion or orbital motion. Further, while the body has been described and illustrated as being in the form of a spray arm it will be understood that any suitable sprayer may be used in any of the above embodiments. For example, the body may include a rotatable disk where the drive outlet relatively rotates the disk and the actuator moves the valve body within the disk to adjust the rotational speed of the disk.

The patentable scope of the invention is defined by the claims, and may include other examples that occur to those skilled in the art. It will be understood that any features of the above described embodiments may be combined in any manner. Reasonable variation and modification are possible within the scope of the forgoing disclosure and drawings without departing from the spirit of the invention which is defined in the appended claims.

What is claimed is:

1. A dishwasher for washing dishes according to an automatic cycle of operation, comprising:

a tub at least partially defining a treating chamber for receiving dishes for cleaning;

a spraying system supplying liquid to the treating chamber and having a sprayer comprising:

a sprayer body mounted within the tub for movement about a rotatable axis and having an interior;

a liquid passage provided in the interior;

at least one spray outlet extending through the sprayer body and in fluid communication with the liquid passage and configured to emit a spray of liquid into the treating chamber to wash the dishes;

a drive outlet comprising only a single opening extending through the sprayer body and configured to emit a spray of liquid to rotate the sprayer body about the rotational axis; and a valve body reciprocally moveable relative to the sprayer body to fluidly couple different portions of the single opening of the drive outlet to the liquid passage to alter an amount of liquid emitted from the drive outlet to adjust a speed of rotation of the sprayer body.

2. The dishwasher of claim 1, further comprising an actuator operably coupled to the valve body to move the valve body to control the amount of liquid emitted from the drive outlet.

3. The dishwasher of claim 2 wherein the actuator is operably coupled with the sprayer body.

4. The dishwasher of claim 3 wherein rotation of the sprayer body moves the valve body to change the speed of rotation of the sprayer body.

5. The dishwasher of claim 4 wherein the sprayer comprises a rotating spray arm.

6. The dishwasher of claim 5 wherein the actuator reduces the speed of rotation of the rotatable spray arm.

7. The dishwasher of claim 6 wherein the speed is reduced when the at least one spray outlet emits the spray of liquid in a corner of the treating chamber.

8. The dishwasher of claim 5 wherein the spray arm includes a first end and a second end with a drive outlet located on both the first end and the second end.

9. The dishwasher of claim 8 wherein the actuator is configured to move the valve body to a first position where the valve body limits the fluid emitted from the drive outlet on the first end.

10. The dishwasher of claim 9 wherein the actuator is configured to move the valve body to a second position where the valve body limits the fluid emitted from the drive outlet on the second end.

11. The dishwasher of claim 5 wherein the valve body is located within the spray arm.

12. The dishwasher of claim 11 wherein the valve body is reciprocally moveable along a length of the spray arm.

13. The dishwasher of claim 1 wherein the valve body is a membrane having at least a portion that overlaps with the drive outlet to limit the fluid emitted from the drive outlet.

14. The dishwasher of claim 1 wherein the sprayer body comprises a disk and the drive outlet relatively rotates the disk.

15. The dishwasher of claim 1 wherein the amount of liquid emitted from the drive outlet comprises a volumetric flow rate.

16. A dishwasher for washing dishes according to an automatic cycle of operation, comprising:

a tub at least partially defining a treating chamber for receiving dishes for cleaning;

a spraying system supplying liquid to the treating chamber and having a sprayer comprising:

a sprayer body mounted within the tub for movement about a rotatable axis and having an interior;

a liquid passage provided in the interior;

at least one spray outlet extending through the sprayer body and in fluid communication with the liquid passage and configured to emit a spray of liquid into the treating chamber to wash the dishes;

a drive outlet extending through the sprayer body and configured to emit a spray of liquid to rotate the sprayer body about the rotational axis; and a valve body laterally reciprocally moveable relative to the sprayer body to fluidly couple different portions of the drive outlet to the liquid passage to alter an amount of liquid emitted from the drive outlet to adjust a speed of rotation of the sprayer body.

17. A dishwasher for washing dishes according to an automatic cycle of operation, comprising:

a tub at least partially defining a treating chamber for receiving dishes for cleaning;

a spraying system supplying liquid to the treating chamber and having a sprayer comprising:

a sprayer body in the form of a rotating spray arm mounted within the tub for movement about a rotatable axis and having an interior;

a liquid passage provided in the interior;

at least one spray outlet extending through the sprayer body and in fluid communication with the liquid passage and configured to emit a spray of liquid into the treating chamber to wash the dishes;

a drive outlet extending through the sprayer body and configured to emit a spray of liquid to rotate the sprayer body about the rotational axis; and a valve body reciprocally moveable along a length of the spray arm to fluidly couple different portions of the drive outlet to the liquid passage to alter an amount of liquid emitted from the drive outlet to adjust a speed of rotation of the sprayer body.

* * * * *